US006823924B2

(12) United States Patent
Martin

(10) Patent No.: US 6,823,924 B2
(45) **Date of Patent: *Nov. 30, 2004**

(54) INSECT SCREENS

(76) Inventor: Conrad Peter Martin, 66 Ovesdon Ave., Harrow, Middlesex (GB), HA2 9PD ( * ) Notice: Subject to any disclaimer, the term of this patent is extended or adjusted under 35 U.S.C. 154(b) by 0 days.

This patent is subject to a terminal disclaimer.

(21) Appl. No.: 10/252,894

(22) Filed: Sep. 23, 2002

(65) Prior Publication Data

US 2003/0019172 A1 Jan. 30, 2003

Related U.S. Application Data

(63) Continuation-in-part of application No. 10/170,273, filed on Jun. 11, 2002, now abandoned, which is a continuation-in-part of application No. 10/010,376, filed on Dec. 6, 2001.

(30) Foreign Application Priority Data

Jul. 30, 2001 (GB) ..... 0018513
May 13, 2002 (GB) ..... 0210880

(51) Int. Cl.[7] ..... A47H 1/00
(52) U.S. Cl. ..... 160/105; 160/273.1; 52/656.1
(58) Field of Search ..... 160/105, 194, 160/273.1, 371; 52/197, 209, 656.1

(56) References Cited

U.S. PATENT DOCUMENTS 3,566,950 A * 3/1971 Collins ..... 49/406
3,732,913 A * 5/1973 Wrono ..... 160/133
4,326,577 A * 4/1982 Tse ..... 160/259
6,016,861 A * 1/2000 Davis ..... 160/105
6,082,432 A * 7/2000 Kissinger ..... 160/290.1
6,123,135 A * 9/2000 Mathews ..... 160/26
6,138,739 A * 10/2000 Crider et al. ..... 160/273.1
6,186,215 B1 * 2/2001 DeYoung et al. ..... 160/290.1
6,240,996 B1 * 6/2001 Runions ..... 160/105
6,276,091 B1 * 8/2001 Ridgway ..... 49/125
6,357,507 B1 * 3/2002 Stoebich et al. ..... 160/41

FOREIGN PATENT DOCUMENTS

GB 2381288 * 4/2003 ..... 160/105

* cited by examiner

*Primary Examiner*—Bruce A. Lev
(74) *Attorney, Agent, or Firm*—Galgano & Burke, LLP

(57) ABSTRACT

An improved flyscreen to be slidingly deployed across an opening of window or door, the window or door having a static glazing pane or panel and an opening pane or panel, the flyscreen comprising a frame dimensioned to correspond to the dimensions of the window or door opening to be covered by the flyscreen and having a mesh screen therein extending thereacross, the frame having a brush or filamentous pad strip extending substantially the full height of an upright of the frame and which when the screen is slidingly mounted adjacent to a window or door to be slidingly moved back and forth across the opening of the window or door, is substantially able to brush over the surface of the static pane or panel of the window or door.

10 Claims, 12 Drawing Sheets

INSECT SCREENS

RELATED APPLICATION

This is continuation-in-part of U.S. Ser. No. 10/170,273, filed Jun. 11, 2002, now abandoned which is a continuation-in-part of U.S. Ser. No. 10/010,376, filed Dec. 6, 2001.

FIELD OF THE INVENTION

The present invention concerns improvements in and relating to insect/fly screens for mounting over door and window openings.

BACKGROUND TO THE INVENTION

Whereas there are currently commercially available a number of different designs of insect/fly screens that are adapted to mount over door and window openings, many of these are hinged to the surround of the opening and are not optimally convenient in use.

More sophisticated fly screen systems have become available in recent years and which are designed to slide on tracks across a door or window opening. As a generality, however, these are formed with a bulky, rigid frame defining the tracks as well as a comparatively bulky and rigid frame of the flyscreen itself.

It is a general object of the present invention to provide a comparatively slim, compact and economical flyscreen installation and which is reliably effective and may be adapted to suit a number of different types of door and window configuration.

SUMMARY OF THE INVENTION

According to a first aspect of the present invention there is provided an improved flyscreen to be slidingly deployed across an opening of window or door, the window or door having a static glazing pane or panel and an opening pane or panel, the flyscreen comprising a frame dimensioned to correspond to the dimensions of the window or door opening to be covered by the flyscreen and having a mesh screen therein extending thereacross, the frame having a brush or filamentous pad strip extending substantially the full height of an upright of the frame and which when the screen is slidingly mounted adjacent to a window or door to be slidingly moved back and forth across the opening of the window or door, is substantially able to brush over the surface of the static pane or panel of the window or door.

Advantageously the flyscreen is installed to a window or door and wherein the upright/jamb of the window or door which defines one side of the opening of the window or door against which the trailing edge upright of the flyscreen frame comes to rest when the screen is drawn to overlie the opening has a mating brush or filamentous pad strip thereon extending at least substantially the length thereof to co-operatively engage/abutt against the brush or filamentous pad strip of the frame to substantially seal the edge of that frame against ingress by any insects.

Suitably one or more further brushes or filamentous pad strips are provided extending vertically and/or horizontally of the flyscreen frame and particularly preferably there is a vertically extending brush or filamentous pad strip on the trailing edge upright of the frame.

Preferably the fly screen is adapted to mount to a sliding window or door having a handle that projects substantially from the plane of the window or door, wherein the brush or filamentous pad strip on the frame is provided on a projecting limb of the frame that projects from the frame toward the plane of the door or window static pane, allowing the mesh screen to clear the door or window handle but ensure that the brush or filamentous pad strip remains closed or brushes over the surface of the door or window static pane as the frame is slid back and forth.

Preferably the projecting limb is adapted to be demountable from the frame.

Advantageously a plurality of interchangeable projecting limbs are provided of differing projection extents to suit different extents of projection of the door or window handles.

Suitably a brush or filamentous pad strip is provided extending along substantially the full length of the top edge of the frame.

Preferably a brush or filamentous pad strip is provided extending along substantially the full length of the bottom edge of the frame.

Suitably a brush or filamentous pad strip is provided extending along the top edge and/or bottom edge of the projecting limb of the frame.

According to a second aspect of the present invention there is provided an improved flyscreen to be slidingly deployed across the opening of a window or door and being of horizontal roller screen type having a mesh flyscreen on a roller that is mounted, in use, to a top, bottom or side of a door or window opening to be drawn across the opening, the flyscreen assembly further comprising a pair of guide rails extending in use opposite to each other to guide the opposing side edges of the screen as it is extended, wherein at least one and suitably both of the guide rails has a brush extending therealong substantially the length thereof and is/are provided with an adjustable stabiliser/gripping bar extending therealong substantially the length thereof to grip and stabilise the screen against the brush(es) to counter sag and/or disturbance by the wind or other disruptive forces.

Preferably the stabilising/gripping bars are provided with Velcro™ or other fastening means to fasten to the edge of the mesh screen, gripping the screen in place.

Advantageously the roller blind is arranged to extend in a substantially vertical direction and the screen is extended or retracted by a drawstring.

Preferably the screen is arranged vertically and the leading edge of the screen has a bar extending thereacross which is weighted to facilitate stable deployment of the screen.

Advantageously the roll of the roller blind is held in a roller cassette and wherein the cassette is provided with two rows of brush means, one inward of the other relative to the opening of the roller cassette from which the screen is drawn, whereby the second row of brush means acts as a secondary barrier against ingress of flies.

BRIEF DESCRIPTION OF THE DRAWINGS

A preferred embodiment of the present invention will now be more particularly described by way of example with reference to the accompanying drawings, wherein.

DESCRIPTION OF THE PREFERRED EMBODIMENTS

Figure 1A:
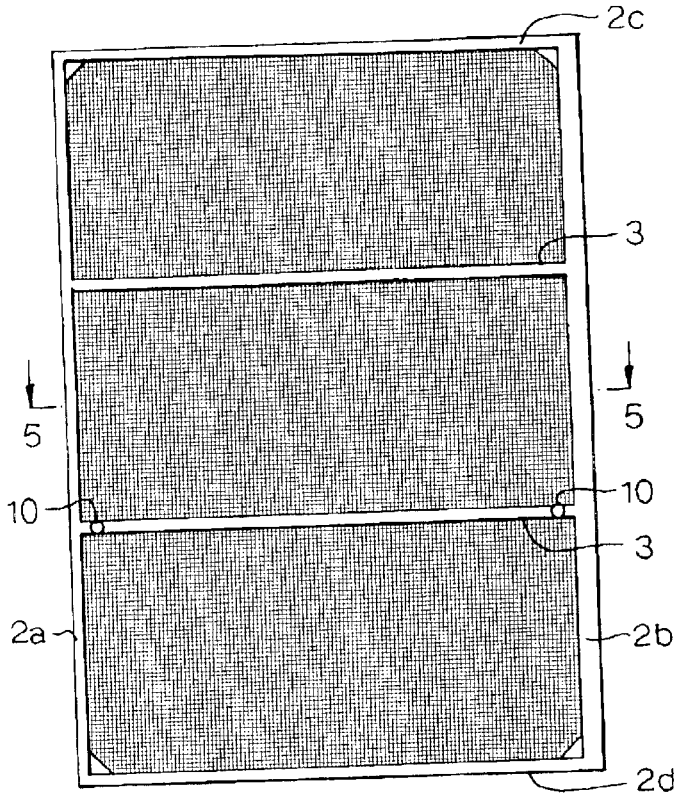
FIGS. 1A and 1B are, respectively, front and rear elevation views of a first embodiment of flyscreen, to be mounted on tracks to slide across a door opening in a set of French windows.
Figure 1B:
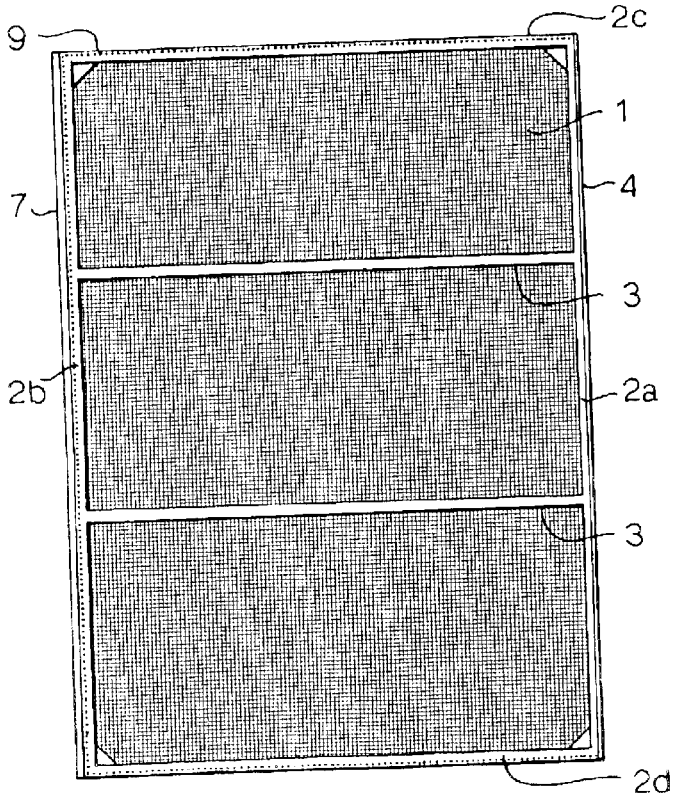

As illustrated in FIGS. 1 to 6, the first embodiment of the insect screen is suitable for use with French windows (glazed sliding doors) and may also be used as a sun screen. It comprises a mesh sheet 1 held substantially taut within a rectangular frame 2*a–d*. This is of a size and shape that corresponds to the size and shape of the French windows or other sliding door installation against which it is adapted to sit. The frame 2*a–d* mounts within an additional channel retro-fitted to or integral with the track of the sliding French window in order to be able to slide across the door opening when the French window/door is slid back to its opened state.

The mesh of the mesh sheet 1 is suitably sufficiently fine to exclude the smallest of flying insect pests such as gnats and mosquitoes. It is suitably of a plastics polymer such as nylon—in which case horizontal strengthening bars 3 are suitably provided at intervals, which are suitably equal intervals but which may be asymmetric, of the height of the screen and extending across the width of the screen. However, where the mesh is formed of a substantially rigid material such as aluminium or other metal or metal alloy, such additional strengthening is generally unnecessary other than, if desired, to act as a clear visual warning that the screen is drawn across the door opening to prevent individuals from failing to notice the fine unobtrusive screen and walking into it.

As can be seen from the side elevation, the insect screen has an extremely slim profile which is in practice suitably of the order of 20 mm or less and generally of the order of 16 mm (this is the depth of the screen, ie as measured from the front face of the screen to the back).

The rectangular frame 2*a–d* is suitably formed of a pair of uprights/stiles 2*a*, 2*b* and top and bottom opposing cross-bars 2*c*, 2*d* all of aluminium, hard, hardened or strengthened plastics, wood or other suitable material that is lightweight but reasonably rigid. In one preferred construction, as can best be seen in FIGS. 1C and 1E, the stiles 2*a,b* and cross-bars 2*c,d* are suitably relatively thin planks being of the order of only 8 mm deep but the stiles 2*a,b* are each re-inforced with a strengthening plank/bar/protrusion 11 that is suitably of the order of a further 8 mm in depth, whereby the profile of the screen is the preferred 16 mm as mentioned above.

The trailing edge stile 2*a* of the frame has a vertically extending brush 4 (preferably bristle brush) which is adapted to ride smoothly over the surface of the underlying static glazing pane 100 of the French windows without damage to the glass if the screen should be pressed against the glass. It co-operatively engages (FIG. 6A) with a corresponding vertically extending brush 5 that is mounted on the static stile 6 of the French windows that borders the door opening opposite the jamb 8.

Abutment of the vertical brush 4 of the trailing edge stile 2*a* of the screen frame against the vertical brush of the static stile 6 gives a firm and insect tight closure of the door opening when the screen is drawn across the opening. A small ramp 15 provided on the static stile 6 adjacent to and leading up to the vertically extending brush 5 serves to guide the vertical brush 4 of the screen's trailing edge stile 2*a* slightly away from the plane of the window as it moves into engagement with the brush 5, the screen thereby being itself pushed slightly away from the plane of the window and so partially wedged against its top and bottom tracks The leading edge of the leading stile 2*b* of the screen illustrated in FIG. 6A has a lip 7 which sits closely against a rail/channel 8*b* on the right door jamb 8 to close against that end of the door opening. Suitably there is a rail/channel 8*b* at both right and left ends of the door opening.

Each of the top and bottom cross-bars 2*c*, 2*d* has their own respective brush 9,10 extending horizontally the length thereof to seal the screen respectively from top and bottom.

The illustrated configuration of fly screen has a pair of small handle knobs 10 provided on the lower of the transverse strengthening bars 3, one knob 10 at each end. A small stowable handle is suitably provided on the rear face of the screen for handling the screen from the outside. This is suitably provided on the transverse bar 3 or on the leading edge stile 2*b* and is particularly suitably pivotable to collapse substantially flat against the screen so that when the screen is fully drawn back against the static pane of the French windows the screen lies very closely against the static pane of the French windows. Such a pivotable handle 12 is illustrated in FIGS. 1C to 1E as comprising a ring 12 that is pivotally mounted to the horizontal strengthening bar 3 by a bearing 13.

Figure 1C:
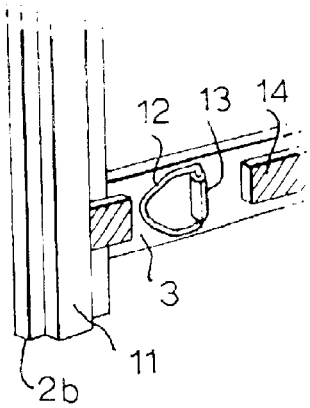
FIGS. 1C, 1D and 1E are, respectively, rear perspective, front elevation and front perspective views of a detail of the screen's leading stile.
Figure 1D:
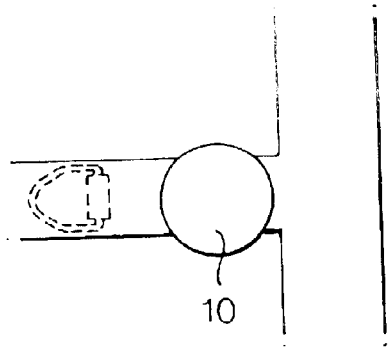
Figure 1E:
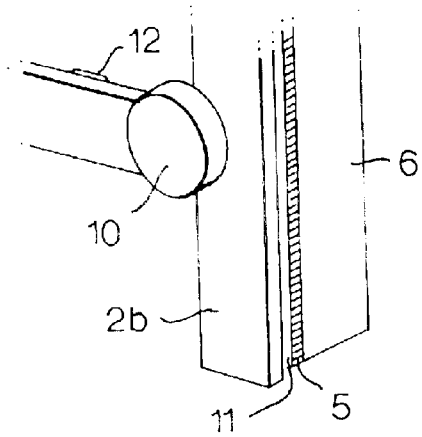
Figure 2:
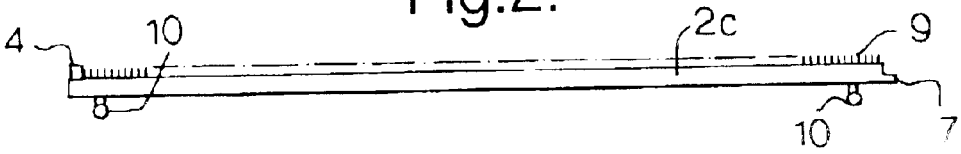
FIG. 2 is a plan view of the flyscreen of the first embodiment from above.
Figure 3:
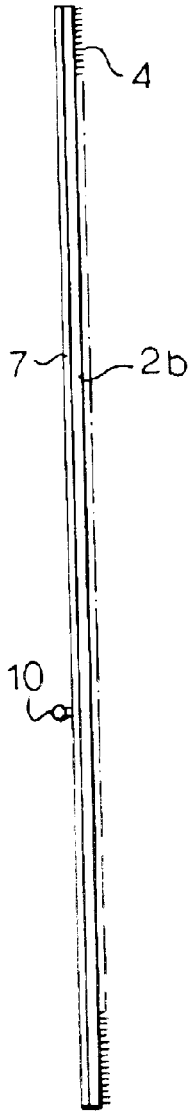
FIG. 3 is an end elevation view of the leading end of the flyscreen.
Figure 4:
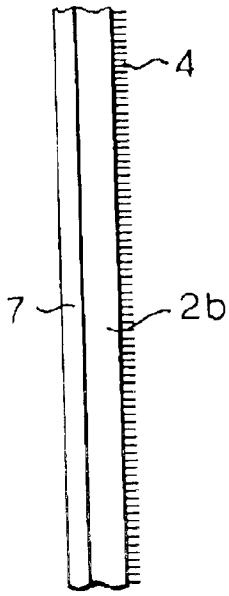
FIG. 4 is an enlarged fragmentary view of the same.
Figure 5:
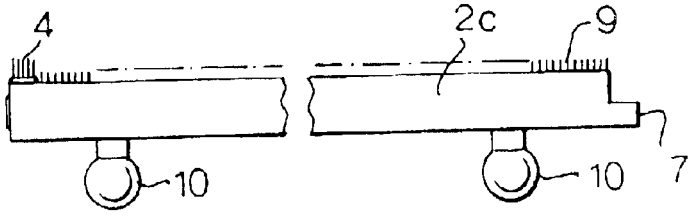
FIGS. 5 and 6A are, respectively, an enlarged fragmentary plan view of the screen as seen in FIG. 2, and a horizontal sectional view of the same.

As also shown in FIG. 1C, a spacer pad 14 is suitably provided at least adjacent to and suitably either side of the pivotal handle 12 primarily to counter risk of the stowed handle contacting the window, but also spacing the cross bar 3 away from direct contact with the window. In the preferred embodiment the pivotal handle is magnetic such as to be magnetically attracted back to its stowed position closely adjacent the screen.

By way of further detail apparent in the figures, the screen is provided with triangular corner pieces at each corner of the frame to better hold the mesh of the screen in place within the frame.

Figure 6A:
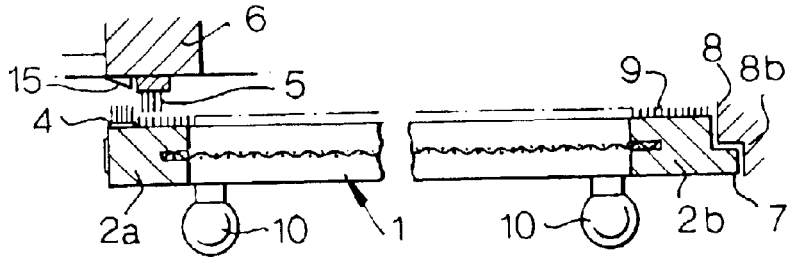
Figure 6B:
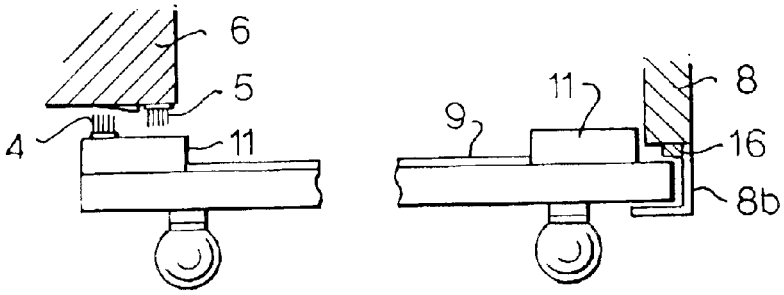
FIGS. 6B and 6C are, respectively, an enlarged fragmentary plan view of the FIG. 1C version of screen (having the upright strengthening bars and with a preferred alternative configuration of channel on the door jamb) at the right of the doorway, and a similar enlarged fragmentary plan view of the screen moved to the stowed position at the left of the doorway.

Turning to FIG. 6B, this shows the FIG. 1C version of the screen as pulled to the doorway-closing position. Here the closure rail 8*b* on the door jamb 8 has a distinct channel-defining shape to ensure that the leading edge 2*b* of the closed screen is constrained closely against the jamb 8. A felt brush spacer pad 16 is further provided in that rail 8*b* to enhance the security of fit of the screen in the channel/rail 8*b*.

Figure 6C:
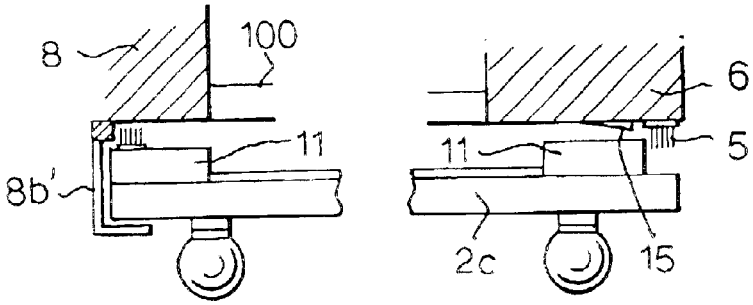

Turning to FIG. 6C, this shows the screen pulled to the stowed position to the left of the doorway. Here there is a corresponding channel-shaped rail 8*b'*.

Figure 7:
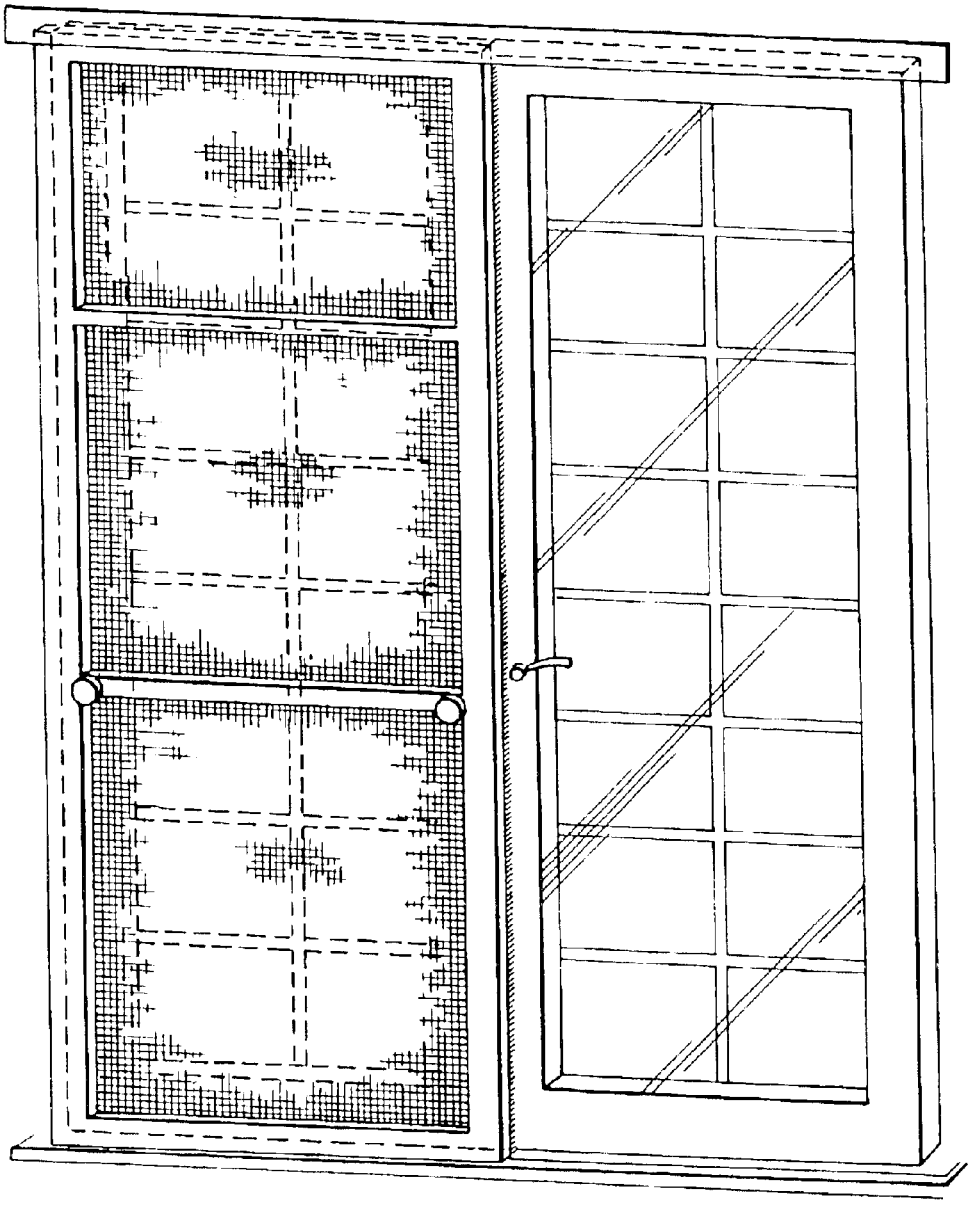
FIG. 7 is a perspective view of a version of the screen mounted to french doors i.e. glazed hinged doors.

With reference to FIG. 7, the illustrated flyscreen for french doors has generally the same construction as the screen for french windows, including having the vertical brush/strip on the trailing edge stile and suitably also on the leading edge stile with the trailing edge one co-operating with a corresponding vertical brush on a central stile of the french doors. One or a pair of such flyscreens may be used with double doors.

Figure 8A:
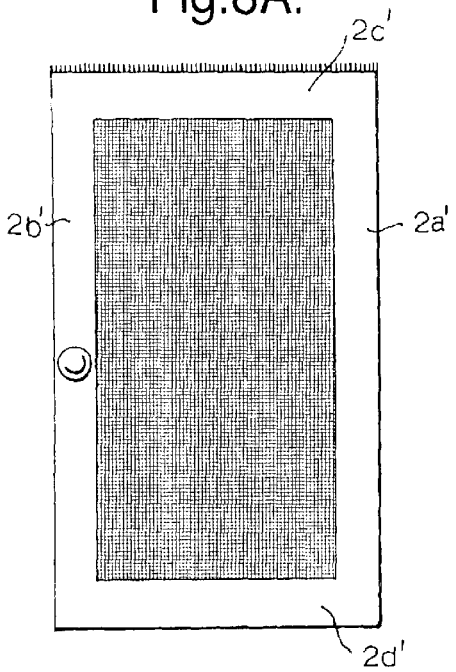
FIGS. 8A and 8B are, respectively, front and rear elevation views of the second preferred embodiment of the present invention suitable for use with windows.
Figure 8B:
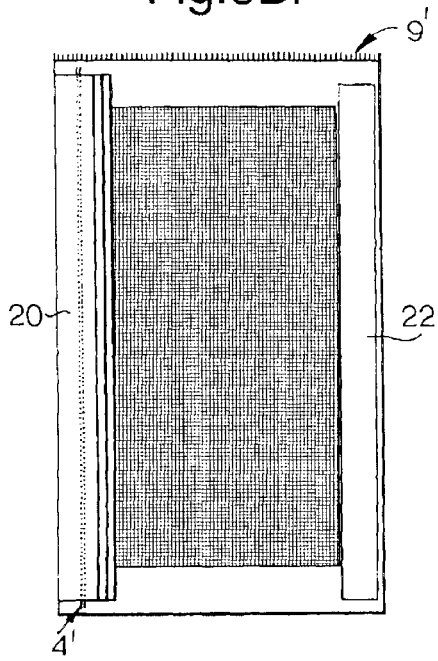
Figure 8C:
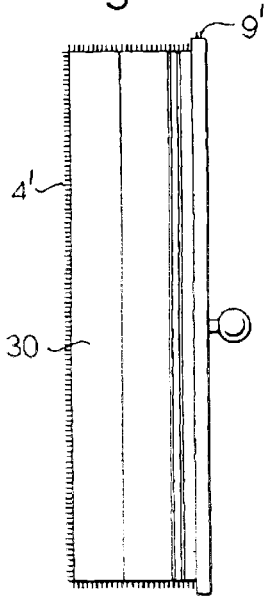
FIG. 8C is an end elevation view of the second preferred embodiment of fly screen.

A second embodiment of the invention, comprising a fly screen for windows, is illustrated in FIGS. 8A through to 11E and has a rigid rectangular frame construction in common with the first aspect The materials and construction are suitably generally the same. The slim construction of the screen frame is again suitably augmented by an upright strengthening bar 22 on the leading stile 2*b*'. However, the trailing edge stile 2*a*' of the fly screen frame 2*a*'–2*d*' is provided with an extension profile 20 that carries the brush 4' of the trailing end of the frame and which is dimensioned suitably to enable the brush 4' to maintain continuous contact with the underlying window while giving the fly screen clearance of the window handle. The depth of the extension 20 is suitably adapted to suit the required clearance.

In a particularly preferred embodiment the extension profile 20 is demountable from the fly screen trailing edge stile 2*a*' to enable selection of the appropriate depth of extension 20 from amongst alternatives. The extension profile suitably keys to the frame by a sliding dovetail arrangement 21 or other keying arrangement (FIG. 9A).

Figure 9:
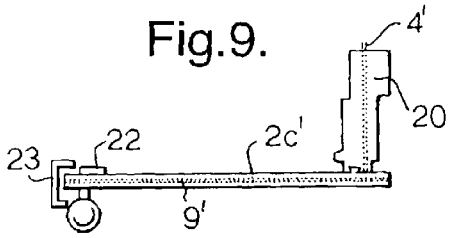
FIG. 9 is a plan view of the second preferred embodiment from above and FIG. 9A is an enlarged fragmentary view of the dovetail mounting of the projecting limb to the fly screen frame in FIG. 9.
Figure 9A:
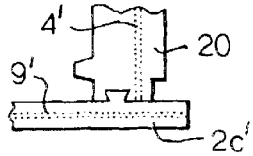
Figure 10A:
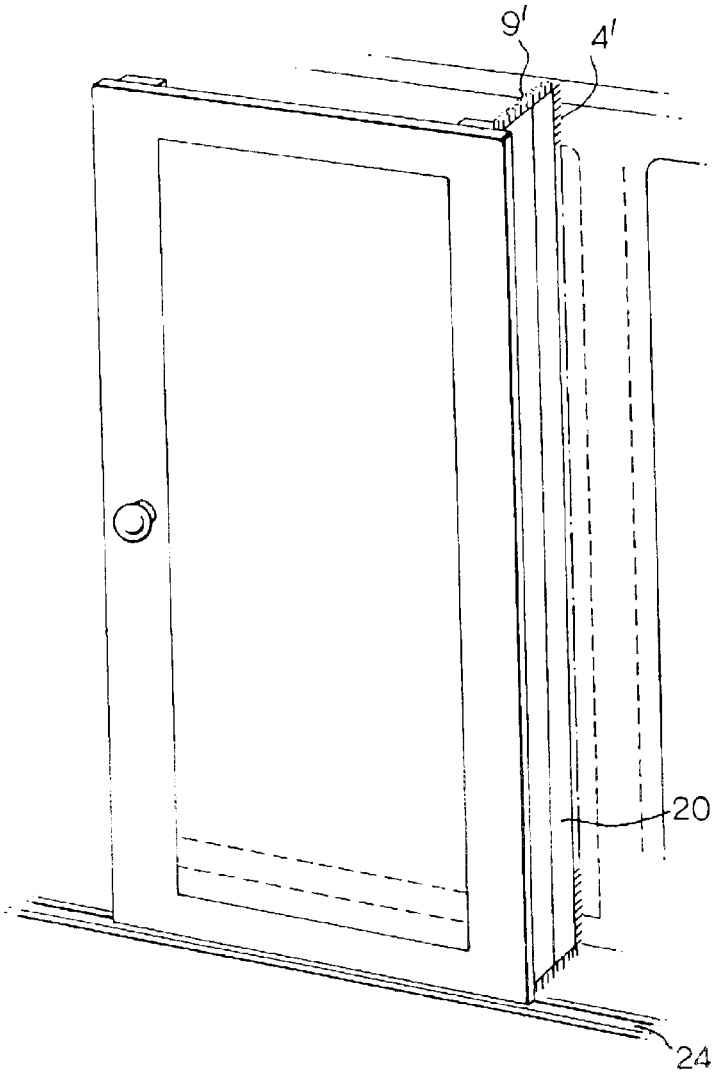
FIG. 10A is a frontal perspective view of a version of the second preferred embodiment (having a simplified profile of extension) and showing the close or brushing passage of the screen's trailing edge brush over a window to which it is mounted.

As can be seen from FIG. 9, a channel 23 is suitably provided at one or both ends of the window opening, again to assist in constraining the screen closely in place when drawn or retracted. Suitably again, the screen runs along tracks 24 in the top and/or bottom (FIG. 10A) of the window opening—preferably both.

Figure 10B:
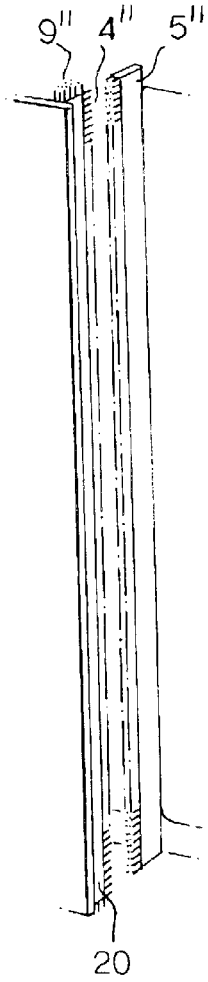
FIG. 10B is a corresponding fragmentary view of an alternative version of the trailing edge brush which is fore-shortened and arranged to cooperate with a brush on the static stile of the window.
Figure 11A:
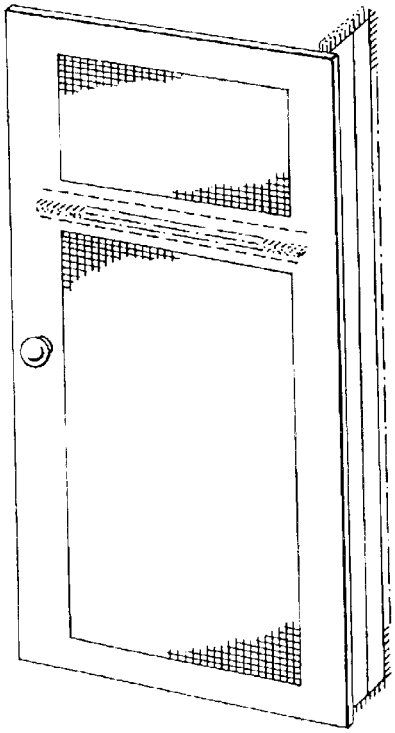
FIGS. 11A to 11D are, respectively, a frontal perspective view of a first further version of the second preferred embodiment of fly screen, a rear perspective view of a second further version (for a window that opens to the right), a rear perspective view of a third further version (for a window that opens to the left or right), and a rear perspective view of a fourth further version (same as third further version but with extra transverse brush on cross-bar)
Figure 11B:
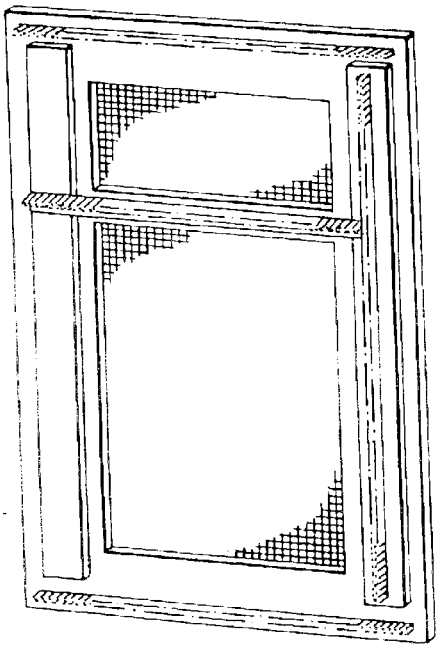
Figure 11C:
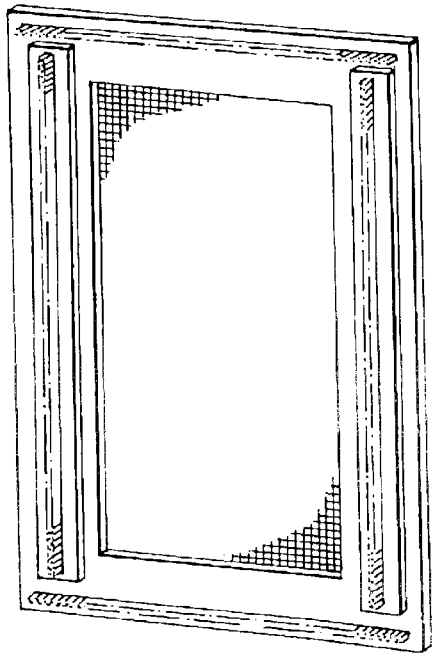
Figure 11D:
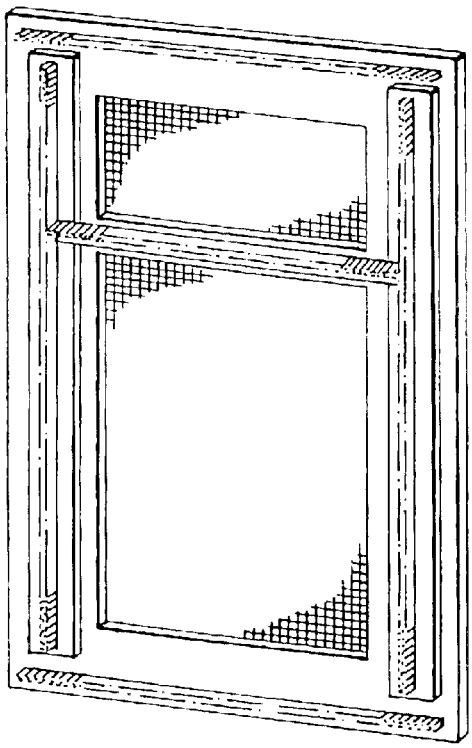
Figure 11E:
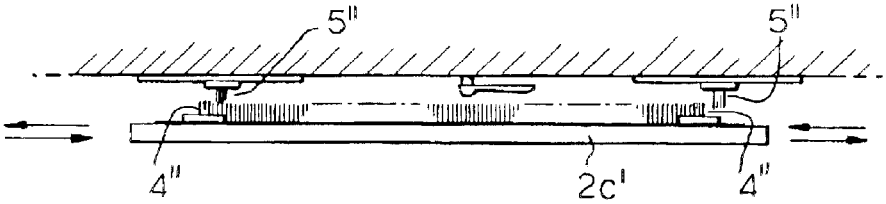
FIG. 11E is a plan view of the fourth further version mounted to a window.

Brushes 9' are suitably provided not only along the top and bottom bars 2*c*', 2*d*' of the screen frame and the profile extension 20 of the trailing edge but optionally also along the leading edge. Where a brush is provided down the leading edge 2*b*' this is suitably a felt brush rather than a bristle brush in contrast to the others. Various preferred configurations of brush are shown in FIGS. 11A to 11D As in the embodiment of FIGS. 1 to 6, the brush 4' will suitably abut/engage with a corresponding brush 5' on an upright of the sliding window when the screen 1' is fully extended across the window opening. Referring to FIG. 10B, the profile extension 20 may be made somewhat shorter than to cover the gap between screen and window when the corresponding brush 5' on the upright is provided and is made taller, ie to project farther out from the plane of the window to meet with the shorter extension 20.

Figure 12A:
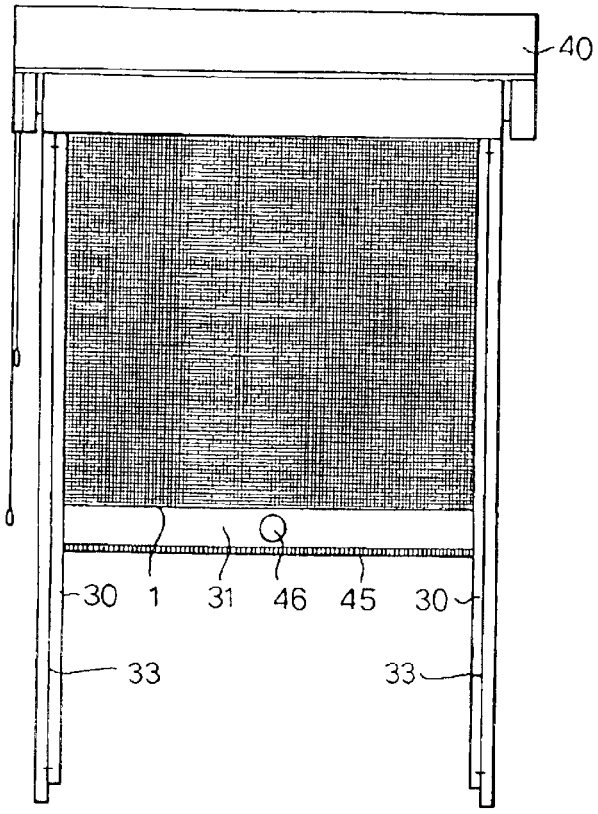
FIG. 12A is a front elevation view of a third preferred embodiment of the invention, comprising a flyscreen of roller screen type.
Figure 12B:
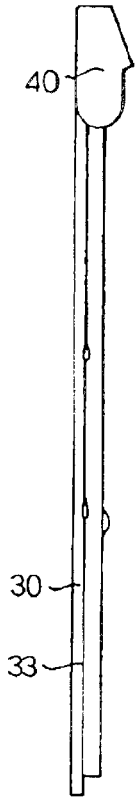
FIG. 12B is an end elevation view of the FIG. 12A embodiment.
Figure 12C:
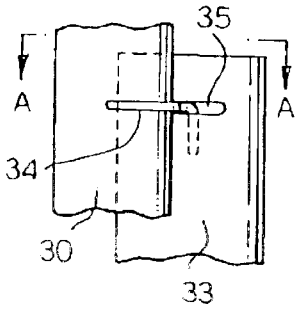
FIG. 12C is a fragmentary view of a track and stabilising/gripping bar as viewed from the left hand side at detail A in FIG. 12A.
Figure 13A:
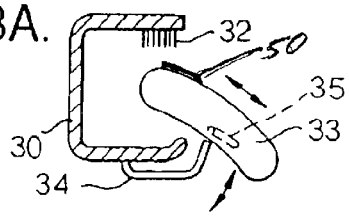
FIGS. 13A and 13B are, respectively, fragmentary plan views from above of the details shown in FIG. 12C and showing the stabilising/gripping bar partially released and in locking engaged state, respectively.
Figure 13B:
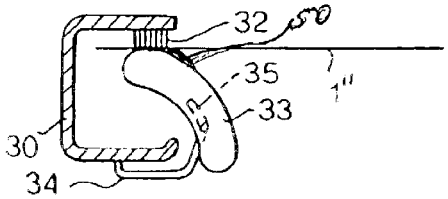
Figure 14A:
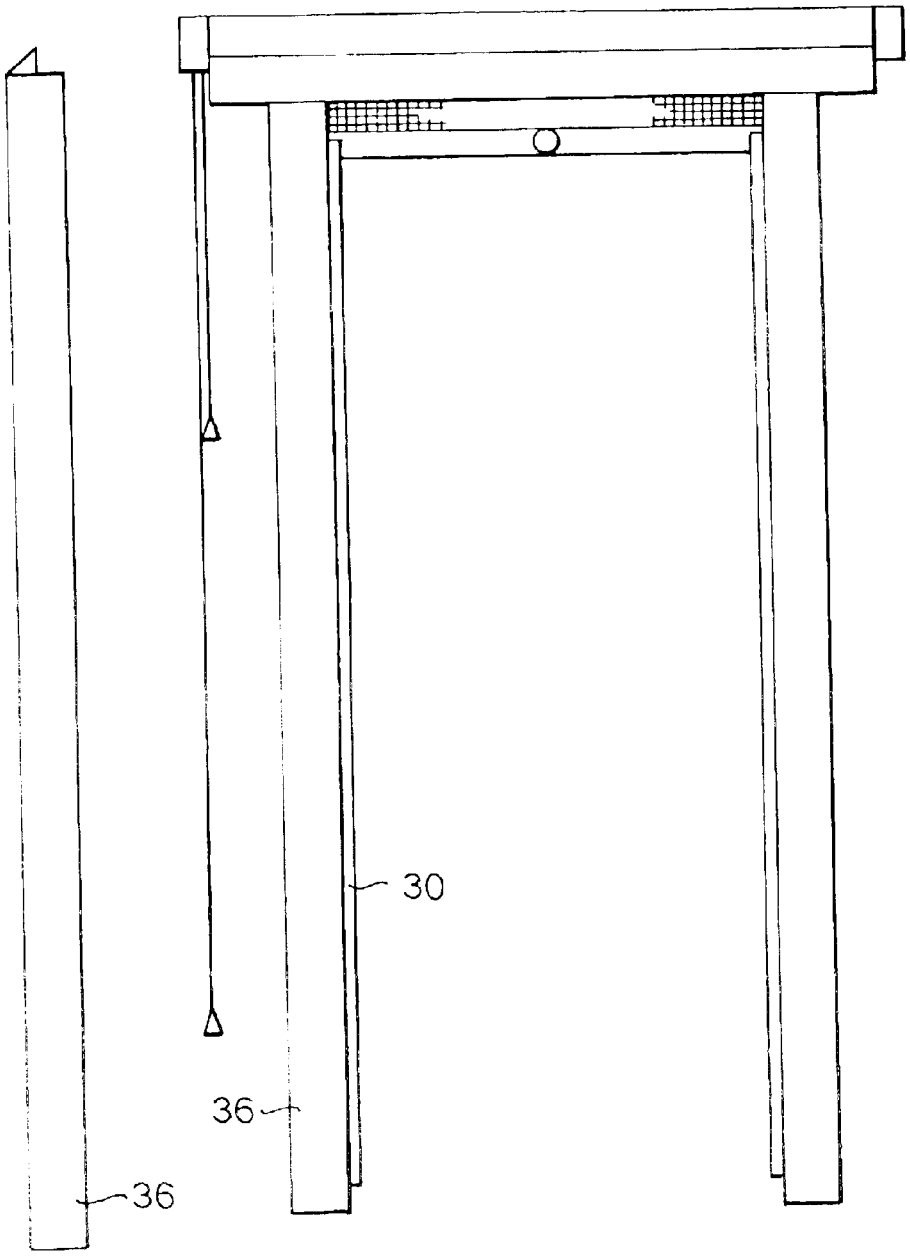
FIGS. 14A, 14B and 14C are, respectively, a front elevation view of the third embodiment showing covers concealing the upright tracks and with the screen raised, a transverse sectional view through the roller screen top casing/roller cassette, and a frontal view of the secondary brush component thereof.
Figure 14B:
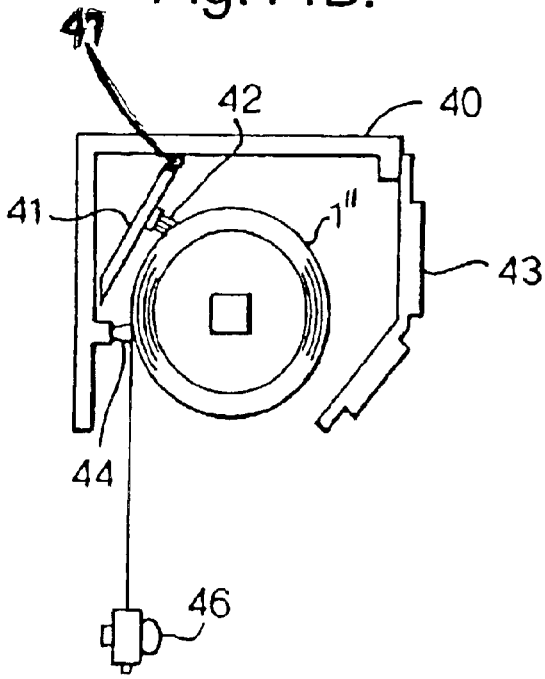
Figure 14C:
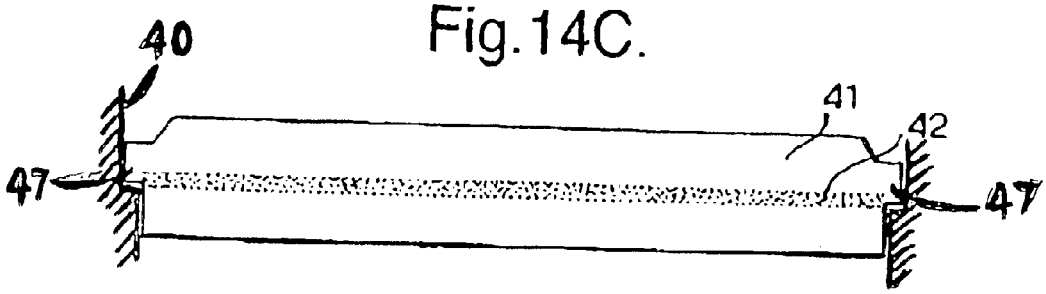

Turning now to FIGS. 12 to 14, these illustrate a roller blind-like insect screen which has a mesh sheet 1" on a roll that may be pulled downwardly with its opposing lateral edges running in a pair of upright U-shaped channel tracks 30, each of which tracks 30 is preferably encased in a cover 36 (FIG. 14A).

It may optionally also have a corresponding bottom track (not shown). It is preferably cord adjustable for deployment, since a spring-loaded gravity drop mechanism is unreliable.

The bottom bar 31 of the screen is suitably weighted with lead weights or the like to give stability and provide balance from front to back of the bar 31. A handle knob 46 is provided mid-way along the bar 31 to facilitate manual manipulation into place.

The strength of the screen 1 and support for the weighted bottom bar 31 is enhanced through provision of thickened solid 1 cm edging to the screen 1.

The top casing/roller cassette 40 has a removable front cover 43 and, along the back thereof, a brush 44 extending the length thereof to exclude flies.

A removable secondary fly trap is suitably positioned in the top casing/roller cassette 40 of the roller comprising a plastic molding 41 that pivotally hangs by a pivot 47 from the roof of the cassette 40 and extends the length of the roller the molding 41 having a brush 42 running along its length that rests on the screen roll 1" and accordingly remains continuously in contact with the screen roll 1" as the screen is extended or retracted and as the roll 1" correspondingly decreases or increases in diameter. The molding 41 having the brush 42 is suitably pivotally mounted via pivot 47 to the cassette 40.

The upright tracks 30 on either side of the roller screen 1" each have a bristle brush 32 along one longitudinal edge and a stabiliser panel/wing 33 along the opposing longitudinal edge. Each of the wings 33 is adjustably mounted to its track 30 on hinges 34. The hinges 34 take the form of bent pins being elongate and mounting in slots 35 in the wings 33 so that the wings 33 may be deployed by pulling laterally across and pivoting outwardly to release the edges of the roller blind screen 1" to allow it to be pulled down. The wings 33 are then pivoted back and pushed back into the tracks 30 so that their curved rear faces push into and thereby to grip the fly screen against the brushes 32 in the tracks 30 once the screen is fully drawn down and deployed.

A strip of Velcro™ 50 or similar is suitably provided on the rear face of each wing 33 preferably extending substantially along its length to enhance its grip. This gripping of the fly screen once the screen is deployed holds it firmly in place against any gust of wind.

In the absence of a bottom track or not, the bottom edge/leading edge of the screen is suitably provided with a short felt brush 45 therealong and which effectively seals against the windowsill.

What is claimed is:

1. An improved flyscreen adapted to be slidingly deployed across the opening of a window or door and being of a type having a mesh flyscreen on a roller that is adapted to be mounted, in use, to a top, bottom or side of a door or window opening to be drawn across the opening, the flyscreen assembly further comprising a pair of guide rails extending in use opposite to each other to guide the opposing side edges of the screen as it is extended, wherein at least one of the guide rails has a brush extending therealong substantially the length thereof and is further provided with an adjustable stabilizer/gripping bar extending therealong substantially the length thereof to grip and stabilize the screen against the brush, the stabilizer/gripping bar lying over the front face of the mesh flyscreen and which may be pulled outwardly away from the flyscreen to allow the screen to be deployed and then pushed back against the flyscreen and brush to grip the flyscreen against the brushes once the screen has been deployed.

2. An improved flyscreen as claimed in claim 1, wherein the stabilizing/gripping bar is provided with fastening means to fasten to the brush and the mesh screen, gripping the screen in place.

3. An improved flyscreen as claimed in claim 1, wherein the flyscreen is arranged to extend in a substantially vertical direction and the screen is extended or retracted by a drawstring.

4. An improved flyscreen as claimed in claim 1, wherein the screen is arranged vertically and the leading edge of the screen has a bar extending thereacross which is weighted to facilitate stable deployment of the screen.

5. An improved flyscreen as claimed in claim 1, wherein the flyscreen comprises a roller cassette in which the flyscreen is held when rolled up and wherein the cassette is provided with two rows of brushing means, one inward of the other relative to the opening of the roller cassette from which the screen is drawn, whereby the second row of brushing means acts as a secondary barrier against ingress of flies.

6. An improved flyscreen as claimed in claim 5, wherein the second row of brushing means is pivotally mounted to the cassette to hang into continuous contact with the roll as the screen is extended or retracted.

7. An improved flyscreen as claimed in claim 1, wherein the stabilizing/gripping bars are adjustably mounted via hinges to the respective guiderails.

8. An improved flyscreen as claimed in claim 1, wherein the hinges comprise slots so that the stabilizer/gripping bars may be pulled laterally and pivoted outwardly.

9. An improved flyscreen as claimed in claim 1, wherein the stabilizing/gripping bars are mounted in place by hinges.

10. An improved flyscreen as claimed in claim 9, wherein the hinges comprise slots so that the stabilizer/gripping bars may be pulled laterally and pivoted outwardly.

* * * * *